US006422722B1

(12) United States Patent
Voltolina

(10) Patent No.: US 6,422,722 B1
(45) Date of Patent: Jul. 23, 2002

(54) LIGHTING FIXTURE WITH REMOVABLE ARMS HAVING ELECTRICAL CONNECTION MEANS

(76) Inventor: Francesco Voltolina, S. Marco, 2759, I-30124, Venezia (IT)

( * ) Notice: Subject to any disclaimer, the term of this patent is extended or adjusted under 35 U.S.C. 154(b) by 0 days.

(21) Appl. No.: 09/509,407

(22) PCT Filed: Apr. 21, 1998

(86) PCT No.: PCT/EP98/02396

§ 371 (c)(1),
(2), (4) Date: Mar. 27, 2000

(87) PCT Pub. No.: WO99/27295

PCT Pub. Date: Jun. 3, 1999

(30) Foreign Application Priority Data

| | | |
|---|---|---|
| Nov. 21, 1997 | (IT) | BS97A0094 |
| Nov. 27, 1997 | (IT) | BS97A0096 |
| Dec. 2, 1997 | (IT) | BS97A0098 |

(51) Int. Cl.[7] ..... F21S 8/06

(52) U.S. Cl. ..... 362/405; 362/147; 362/226; 362/249; 362/406; 439/841

(58) Field of Search ..... 362/145, 147, 362/226, 249, 382, 391, 405, 406, 806; 439/112, 116, 119, 120, 841, 840, 816

(56) References Cited

U.S. PATENT DOCUMENTS

| | | | | |
|---|---|---|---|---|
| 2,234,745 A | * | 3/1941 | von Rarrel | 439/116 |
| 3,513,434 A | * | 5/1970 | Zielke | 439/709 |
| 3,651,443 A | * | 3/1972 | Quilez | 439/112 |
| 4,079,244 A | * | 3/1978 | Bortoluzzi | 362/405 |
| 4,107,770 A | * | 8/1978 | Weber | 362/405 |
| 4,838,815 A | * | 6/1989 | Tajima et al. | 439/841 |
| 5,873,652 A | * | 2/1999 | Bayer et al. | 362/405 |
| 5,906,520 A | * | 5/1999 | Frinker et al. | 436/841 |

* cited by examiner

*Primary Examiner*—Sandra O'Shea
*Assistant Examiner*—Ismael Negron

(57) ABSTRACT

A lighting fixture with arms, comprising at least a central body, a plurality of protruding radial arms and clutching means for fastening said arms to the central body and for the electric connection of the bulb-carrying arms, comprising a fixed element (1) connected to said central body and a movable element (3,3') connected to the end portion of each arm and introduced into the fixed element (1).

The movable element (3'), connected to the end of an arm (4) carrying no bulb, is provided at the end portion with a blind tube (25) and the movable element (3), connected to the end of an arm (5) carrying a bulb (6), is provided with two electrical wins (41) connecting a bulb-holder for the bulb (6) to an electric contact means (15,17) that protrudes from the movable element (3) facing the fixed element(1).

4 Claims, 8 Drawing Sheets

LIGHTING FIXTURE WITH REMOVABLE ARMS HAVING ELECTRICAL CONNECTION MEANS

The present invention relates to a lighting fixture with arms. More particularly, the present invention relates to a lighting fixture comprising one or more central bodies and a plurality of protruding radial arms, and provided with means for a quick and easy mechanical positioning and electric connection of the arms in the central body.

Lighting fixtures comprising a centered body and a plurality of protruding radial arms and provided with means for a quick and easy mechanical and electrical connections of the arms to the centered body are known from GB No. 416, FR-A-2377576; DE 8905616 and U.S. Pat. No. 6,707, 770.

As used herein and in the claims, the term "lighting fixture" comprises any lighting device from metal, glass, wood, majolica, plastic material or other materials, which hangs from the ceiling or rests on the floor or on a top or is arranged on posts or stands, for artificially lighting a room or also for ornamental purposes. Examples of lighting fixtures comprise chandeliers, wall lanterns, desk lamps, bed lamps and the like. As is known, for the production of such lighting fixtures several operations are performed that comprise:

- the formation of arms which, once provided with bulbs, require a small electric system to be arranged in the inside of their components;
- the complete formation of the central body to which the accessories, the elements necessary to fasten said fixtures to ceilings or walls, the bulb-carrying arms, the arms carrying no bulbs which bear ornamental parts ("pastorals" from crystal, drops from crystal having different shapes and size, supports for other ornamental elements, etc.) are to be assembled;
- the realisation of the whole electrical system which, from the central body, connects all the bulbs of the fixture to one another;
- the arrangement of all the ornamental elements provided and required;
- lastly, the connection of the fixture to the mains.

The actuation of all these operations, and in particular the execution of electric connections, requires much time and work, which still increases if said connections are made in full compliance with the severe norms in force.

The aesthetic completion of these fixture and the accurate packaging they require further increase the engagement of the producers and sellers. Therefore, also these activities are to be considered in the economic balance, especially when the same must be actuated out-house, both by the manufacturers and the sellers of these fixtures.

Object of this invention is to provide contrivances allowing to simplify said work by eliminating some operations, and to obtain an easy and facilitated mechanic positioning and electric connection of the arms of the lighting fixture provided with several arms.

More particularly, object of the present invention is to provide particular arrangements of all the parts which constitute and make up said fixtures, causing their assembly to be easier and more rational, and eliminating the complex and complicated electric systems.

A further object of the present invention is to simplify the mechanical assembly of the arms to the central core of the fixture, and the connection and fastening operations of the same.

A lighting fixture having the features of the preamble of claim 1 is known from GB-A-416. This document discloses a lighting fixture with arms comprising: at least a central body; a plurality of projecting removable radial arms, and means for fastening the arms to the central body and for electrically connecting the bulb-carrying arms to a main consisting of only one clutching means comprising a fixed element, connected to the central body and provided with annular electrical conductors, and a movable element, connected to the end portion of each arm and provided with electrical contact means projecting from its surface and contacting the electrical conductors, when the movable element is inserted into the fixed element.

The lighting fixture of the present invention is characterized in that the electrical conductors are annular coil (spiral) springs located at the base of the fixed element in such a position to contact the corresponding electrical contacts of the movable elements, and in that the electrical contact means of the movable elements are jackplugs; said jackplugs being inserted between two adjoining windings of the coil (spiral) springs, when each movable element is inserted into the corresponding fixed element.

Particular embodiments of the lighting fixture of the present invention are set forth in subclaims 2 to 10.

The mobile clutch between the arm and the central body allows to realise at the same time in one only step both the mechanical connection of each arm to the central body of the fixture, and the electric connections that concern it.

To this aim, the clutch is provided with means to realise at the same time several electric contacts.

Said means may be either a system obtained by means of coiled conductors between which two cylindrical jackplugs are inserted, or a system obtained by means of two thin metal rings that perform the function of coupled conductors, and which, like the first ones, provide-the energy necessary to turn on the bulbs of the chandelier or a prefixed sector of the same. The latter system works by means of contacts constituted by a couple of small metal springs that fit in and remain tight on the cylindrical rings. All the arms radially placed and fastened in the seats of the body supporting said suitably insulated conductors—which are at the same time in contact with the energy source—converge towards the first and the second conductors.

In said fixtures, both the supports and the guides of the bulb-carrying arms are so sized as to support all the arms that have to sustain the ornamental parts that complete the same, as also when the latter have not the function of conducing and transmitting electric energy, they must be arranged and supported by the same means and elements that bear the bulb-carrying arms.

The advantages achieved by the lighting fixtures of the present invention comprise:

- the simplification and speeding up of the processes necessary to produce, prepare and compose the lighting fixtures;
- the speeding up and improvement of all the steps of the assembly of said fixtures;
- the actuation and formation of components ready for the final assembly of the fixture;
- the simplification of the electric systems that must be workmanlike realised for each fixture;
- the possibility of final composition of the fixture also by those that are not skilled in the art;
- the possibility of obtaining perfectly assembled fixtures, without any recourse to adjustments which only those skilled in the art can make once the fixture is mounted;

in case of working defects, the possibility of repairing the same by removing only the defective parts;

the possibility of reducing the size and quality of packages, and consequently the transportation costs.

The constructive and functional characteristics of the lighting fixture according to the present invention will be better understood thanks to the following detailed description, wherein reference is made to the attached drawings which represent some embodiments of the present invention solely reported by way of non limiting indication, and wherein.

Figure 1:
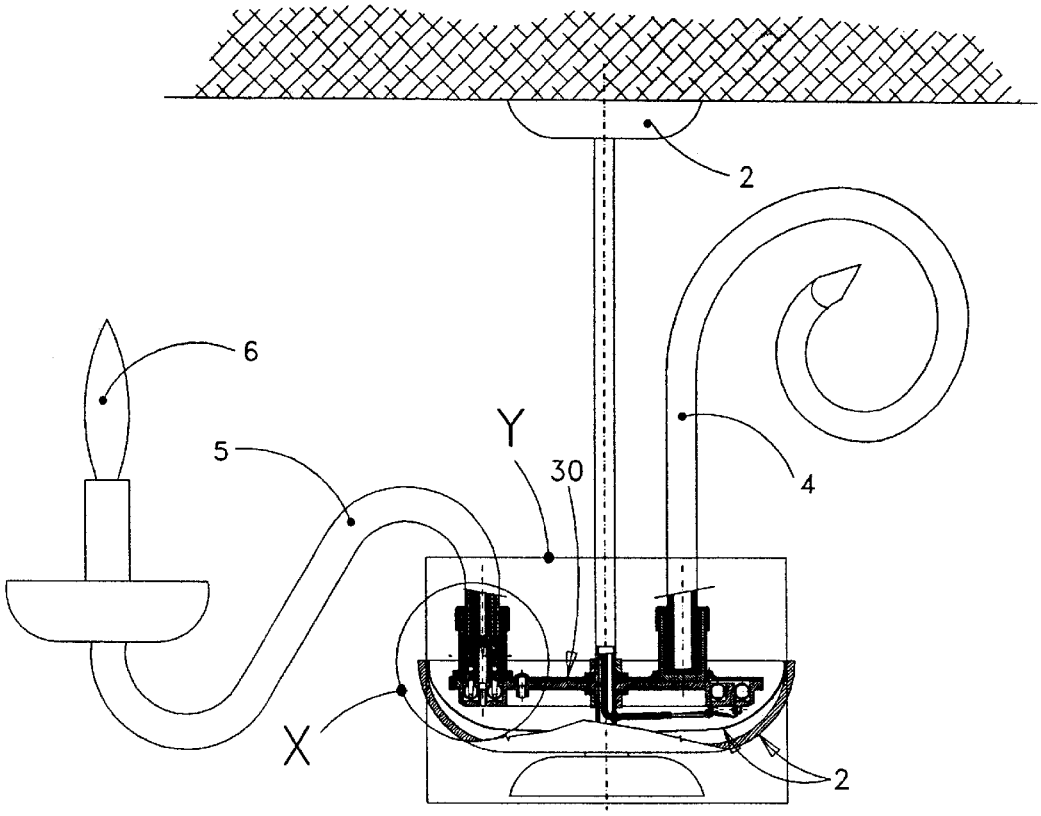
FIG. 1 is a partly sectioned side view of a ceiling chandelier provided with arms either with or without bulbs, radially fastened to a central supporting body or core through mobile clutches, with vertical axis guides actionable from up downwards.

In the following, the present invention will be described by way of example, with reference to the chandeliers illustrated in the figures, even though the same may be applied to any other known lighting fixture provided with arms with or without bulbs.

The chandelier comprises one or several central bodies protected and supported by covering and hooking means (2) and able to keep fixed the radial arms (4, 5) with or without bulbs. Said arms may have different functions, for instance of support for decorative parts; of support for hooking means, bearing means and tie rods; or also of support and guide for the components that form the bearing structure of the whole fixture.

All these figures also show the means that determine and realise at the same time the assembly of the central body of the fixture and determine their electric connection to the same, wherein they shall finally result to be united.

Said means have been designed to ensure the exact assembly of the arms in seats obtained in the central body through clutch-elements which allow to perform the connection and the contact in a safe and quick manner.

Said means for the assembly and electric connection of each arm (4,5, 7, 8, 35, 36) to the central body (30, 31, 32, 33) comprise a fixed element (1) connected to said central body, and a movable element (3, 3'), connected to the end portion of each arm. Said fixed element (1) is always equal and fixed to one of said central bodies and functions as a support and guide for the arms, when the latter are inserted by means of one of the movable elements (3, 3'). Anyhow, it makes part of the central body or bodies of the lighting fixture, even if it is differently applied to the same.

Both the fixed element (1) and the movable element (3, 3') have a tubular cylindrical or polygonal shape and the internal size and shape of the fixed element (1) is substantially equal to or slightly smaller than the external size and shape of the movable element (3, 3'), so that the movable element (3, 3') can be introduced into the fixed one (1).

The movable element (3'), connected to the end portion of an arm (4) carrying no bulbs, comprises a blind tube (25) inserted in said end portion and fixed to the same by means of glues (39). A ring nut (9') can surround and close said tube (25) in its upper open part opposite to the blind part.

The movable element (3), connected to the end portion of a bulb carrying arm (5) comprises an open tube (21) inserted in said end portion and fixed to the same by means of glues. A ring nut (9) can surround and close said tube (21) in its upper open part opposite to the one facing the fixed element (1).

Within said movable element (3) fixed to arm (5) two electric. wires (41) are inserted, connected each, at one end, to a pole of a bulb holder for one bulb (6) and fixed at the opposite end by means of a fastening screw (43) to an electric contact means (15, 17) which protrudes from the surface of the movable element (3) facing the fixed element (1). Said electric contact means may be jackplugs (15) kept in position by two half-bodies (42, 44) inserted into the open tube (21).

Figure 7:
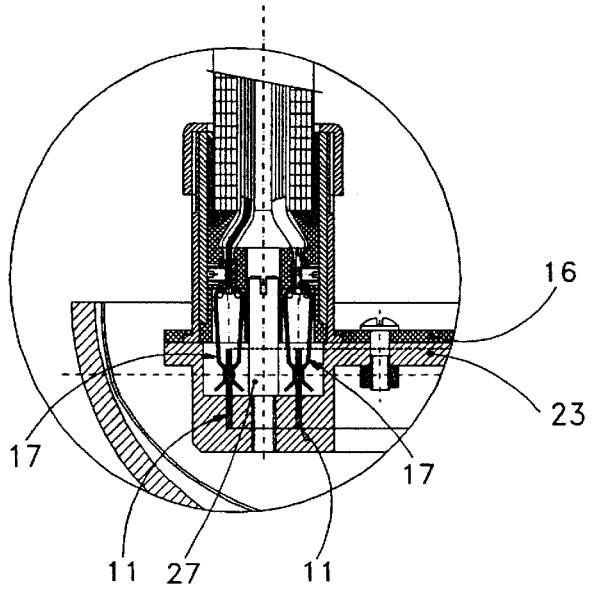
FIG. 7 is the enlarged view of a variant of FIG. 5 and shows a different way to actuate the electric system between the bulb-carrying arms and the central body, by means of spring-clutches which insert in the walls of vertical axis cylindrical conductors.
Figure 8:
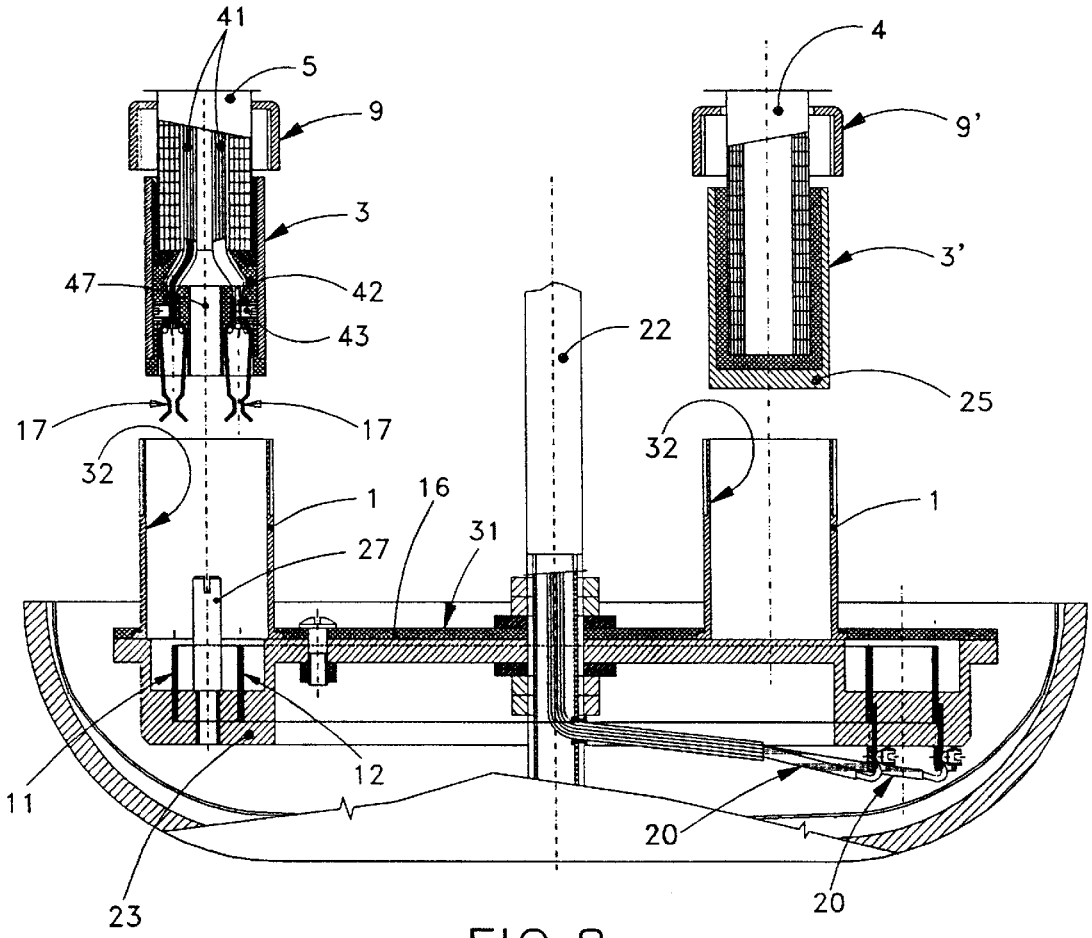
FIG. 8 is the same view as FIG. 6, provided with the electric contacts shown in FIG. 7.

The movable element (3) is also provided with a central guide-hole (47) for its insertion on the fixed element (1). Jackplugs (15) may be replaced by springs (17) constituted by thin metal straps (FIGS. 7–8).

The fixed element (1) comprises an open cylindrical tube fastened to the central body (30, 31) by means of a grommet (16).

The central body comprises a circular insulating element (18, 23), peripherally provided with circular seats (19). Two concentric annular electric conductors (10, 11) are located in said annular seats (19) The circular seats (19) may be divided by an intermediate ring from insulating material. An insulating ring (29) provided with protrusions (27) acting as finger protections, separates and insulates the two annular electric conductors (10, 11). The circular seats (19) and protrusions (27) are arranged at the base of the fixed element (1) and their position is such as to coincide with each jackplug (15) respectively spring (17) and with the central hole (47) when said movable element (3) is inserted in said fixed element (1). The electric conductor may be a coil (10) when the mobile element (3) is provided with jackplugs (15) or a cylindrical foil form metal when the movable element (3) is provided with springs (17).

The coiled annular conductor (10) or the cylindrical foil (11) is connected to the mains through two only wires (20) coming from the mains and passing through, an attachment tube (22) which causes the chandelier to hang from the ceiling.

Figure 14:
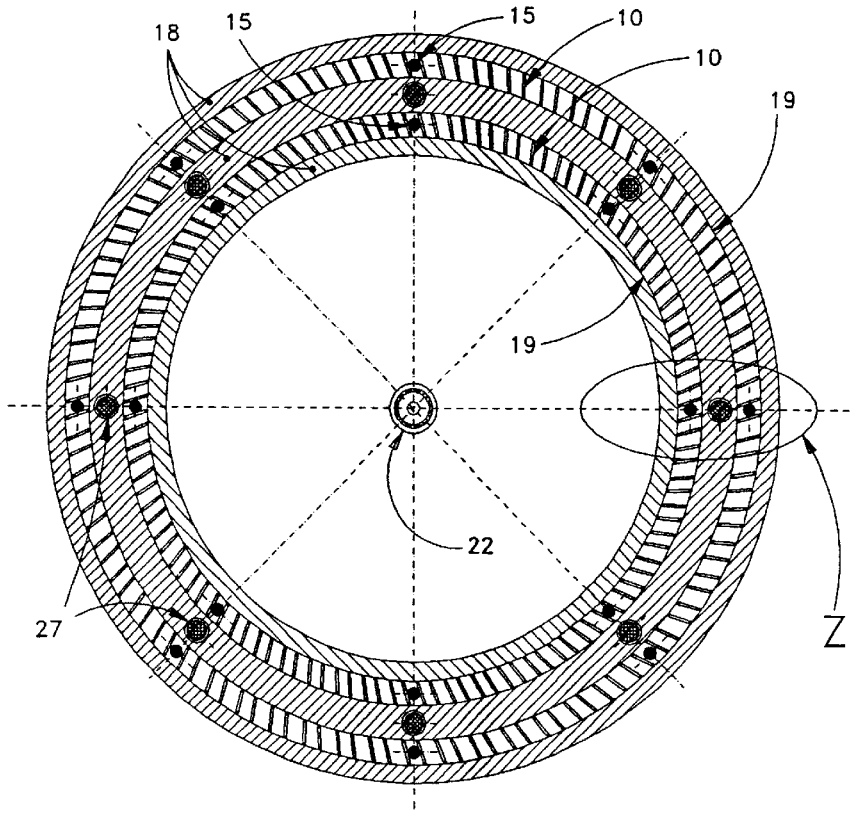
FIG. 14 is the section of the lower element of the central body obtained along the G—G line of FIG. 6; said figure shows how the two coiled conductors are arranged to house the cylindrical jackplugs when the latter, pushed, sets itself between two coils of the same to actuate the necessary. contacts.

The clutches with jackplugs (15) are realised when the latter are pushed and set between two coils of the coiled conductors (10) (FIG. 14).

Figure 15:
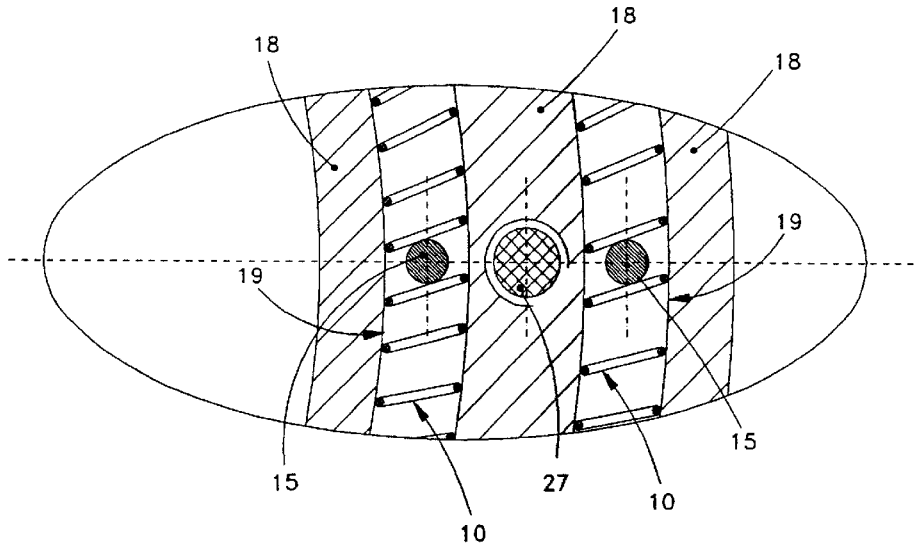
FIG. 15 is the enlarged view of the detail indicated by "Z" in FIG. 14.

Jackplugs (15) remain confined between two adjoining coils, both because of the force developed by the elasticity of the metal which forms a sort of spring and because of the push jackplugs receive from the same, as their diameter is greater than the space where they are contained (FIG. 14 and 15). As shown in FIGS. 7 and 8, the shaped springs (17) actuate the contact when they are forced and caused to clasp the foil conductors (11) fastened in the central and insulating body (23), and connected to the mains through wires (20).

Figure 6:
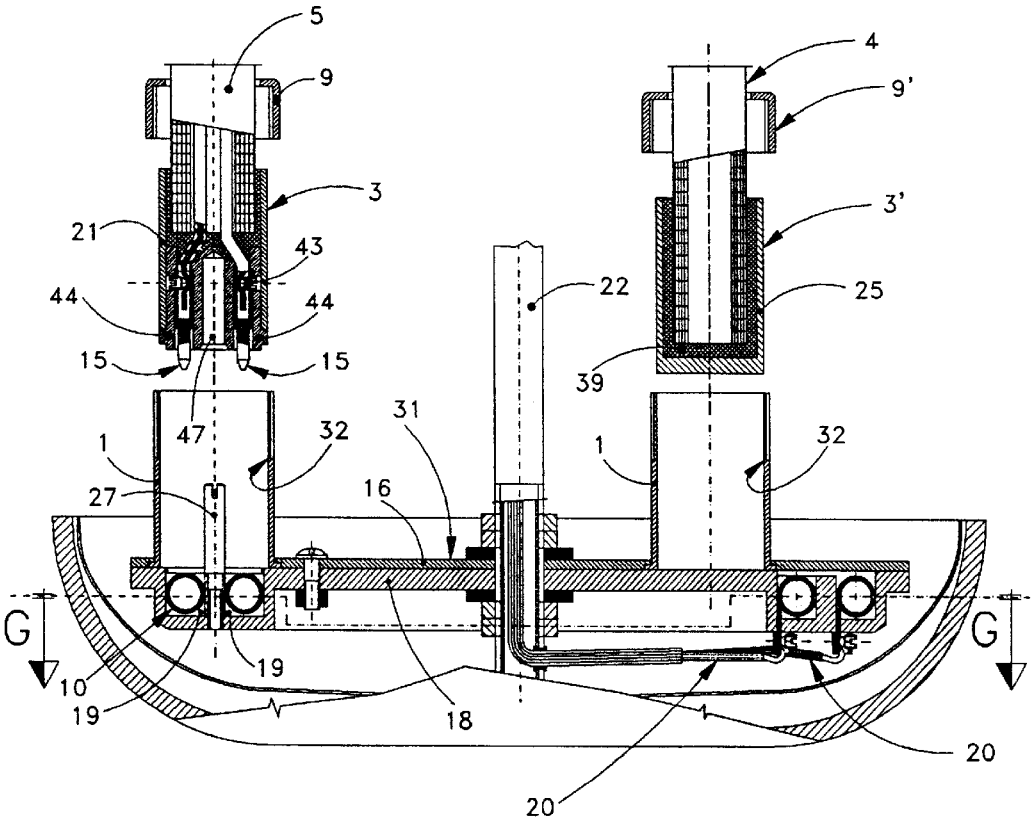
FIG. 6 is the enlarged view of a detail of the lighting fixture, indicated by "Y" in FIG. 1.

FIG. 6 shows how the end movable elements (3, 3') provided on the supporting arms can be inserted in their seats and connected to the annular coiled conductors (10), through a vertical hand manoeuvre from up downwards. FIG. 6, if examined upside-down, shows the movable elements (3, 3') in the position necessary to be inserted in the fixed elements (1) through a vertical hand manoeuvre from down upwards. FIG. 8 shows how the same end movable elements (3, 3') of the bearing arms (4, 5) can be connected to the annular cylindrical conductors (11), always all equal, through a vertical hand manoeuvre to be carried out from up downwards.

FIG. 1 shows how the same movable end elements of the Supporting arms may be connected to the coiled conductors (13), by a manoeuvre to be made by hand horizontally from the outside towards the axis of the fixture, wherein, in some cases, said movable elements (not shown) have to be inserted in fixed elements (1), through manoeuvres to be carried out by hand horizontally and from the body axis outsidewards.

Figure 3:
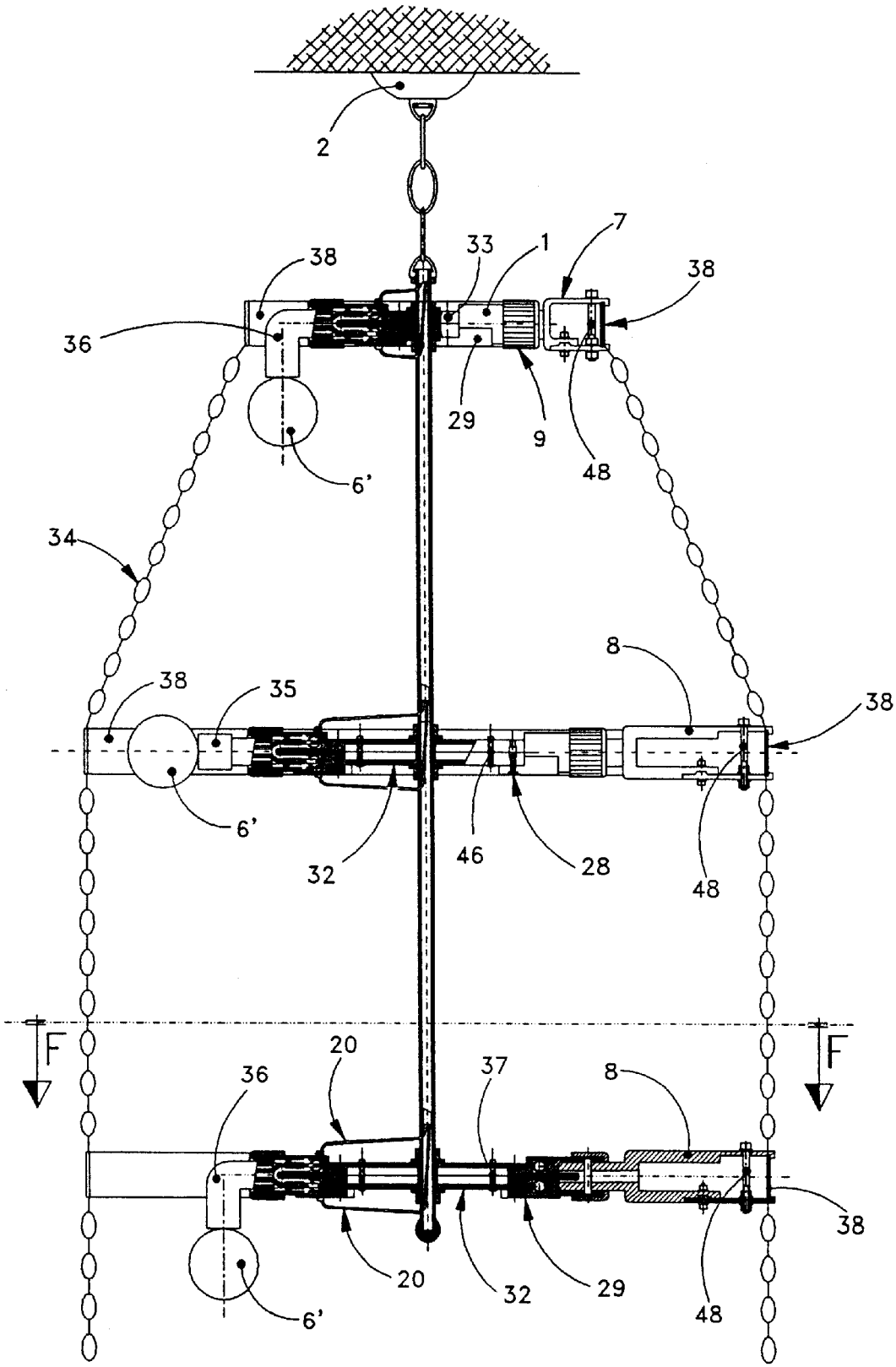
FIG. 3 is the partly sectioned side view of a second ceiling lighting fixture, provided with several central supporting bodies to which several arms, either with or without bulbs, and crystal drops united to one another and supported by the arms carrying no bulbs radially fastened by means of mobile clutches with horizontal axis guides.
Figure 4:
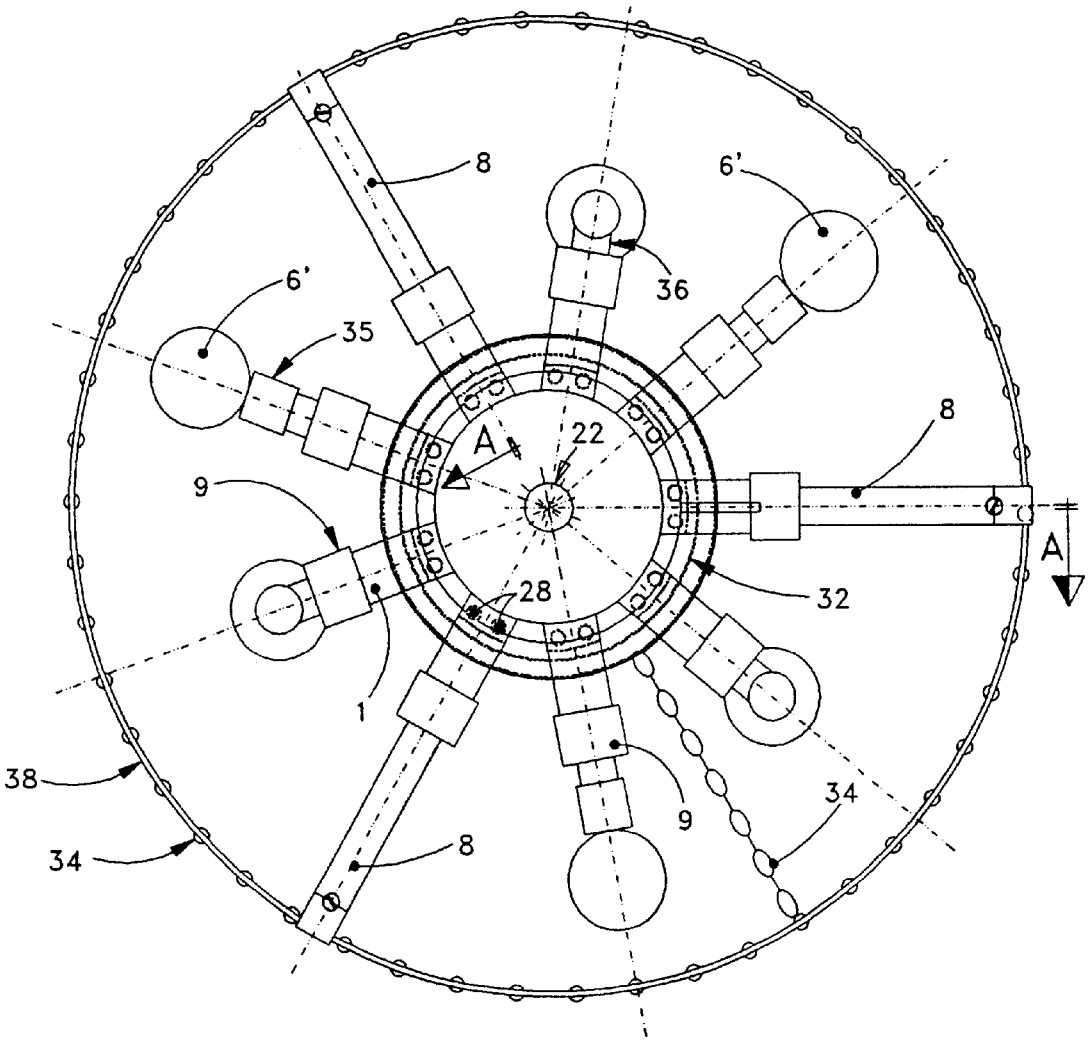
FIG. 4 is the top view of the lighting fixture of the preceding FIG. 3.
Figure 5:
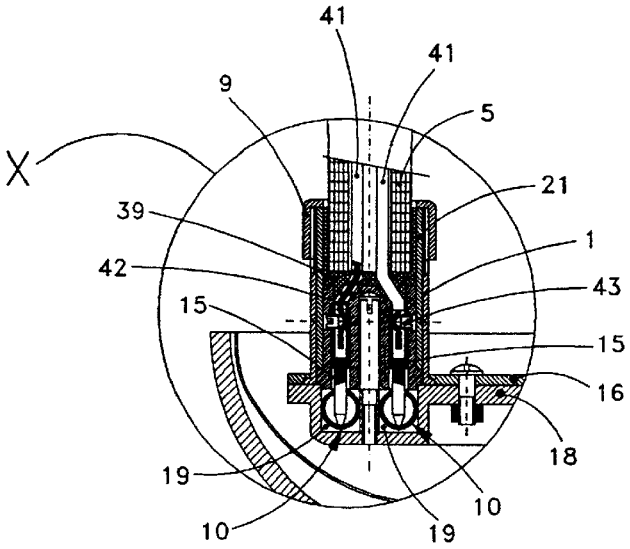
FIG. 5 is the enlarged top view of a detail of the lighting fixture, indicated by "X" in FIG. 1.
Figure 12:
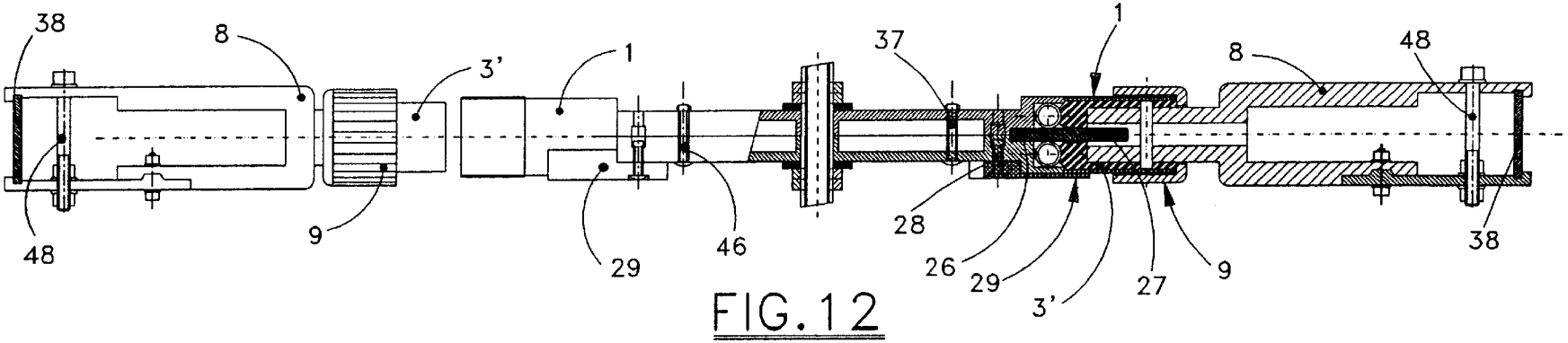
FIG. 12 is the schematic view of the section obtained with a plane passing through the A—A line of FIG. 4.

FIGS. 6, 8 and 12 show the movable elements (3') closed at the end facing the fixed element (1) and devoid of jackplugs (15) or springs (17), being intended for arms carrying no bulbs, while they have to be inserted in the fixed elements (1) to result to be inserted in always equal guides, strongly united to the bodies, aligned with other arms and, as all, introduced by hand in the clutch seats. As such there-have to be considered arms (4) generally known as "PASTORALS" from crystal for chandeliers (FIGS. 1 and 2) and other arms that support decorative elements such as crystal drops (34) (FIGS. 3 and 4). FIGS. 3 and 12 show how are arranged the clutch fixed elements (1) for the movable and blind elements (3') of the fork-arms (7, 8) which, carrying no bulbs, do not require connections and electric contacts.

We shall now examine in detail the contacts of the horizontal fitting systems.

Figure 9:
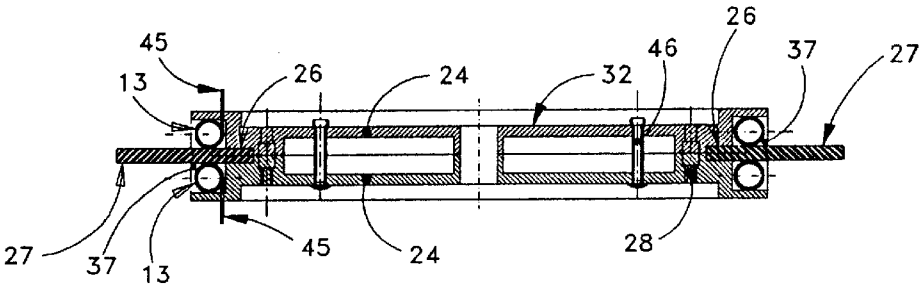
FIG. 9 is the side view of a longitudinal section of one of the two central bodies of the lighting fixture of FIG. 3.
Figure 13:
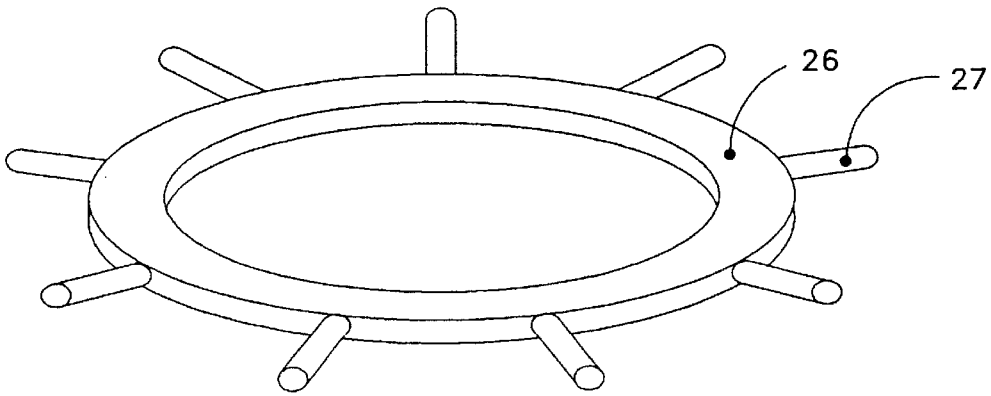
FIG. 13 is the prospect mid-height view of the insulating ring that, assembled between the elements that make up the central body, insulates the two coiled conductors from one another, and places in the right position the circuit breakers.

The central body (32, 33) comprises to shaped flat insulating elements (24) united to one another and forming restraining seats (37) of the concentric coiled conductors (13) (FIG. 9). A shaped insulating ring (26) provided with protrusions acting as finger protections (FIG. 13) separates and insulates the two coiled conductors.

The shaped flat insulating elements (24), which may have different diameters and size, are united to one another by screws or tear off rivets (46) to form said central bodies (32) to which there may be added the movable and skew supports or clutches (29) that act as supports for the arms that require horizontal clutch manoeuvres. Said arms are cantilevered and radial with respect to the body or bodies (32,33) provided with supports (29) united to one of the flat elements (24) through screws (28). They position the fixed seats for the horizontal clutches both for bulb-carrying arms (36) and for arms carrying no bulbs (8), which have the task of bearing and keeping in guide the metal ring or rings (38) which maintain in position all the ornamental crystal drops (34) bound with one another by means of chains. The two elements (24) (FIG. 9) define the circular and peripheral cavities (37), seats of the coiled conductors (13). Said coiled conductors (13) end with extensions (45) to be connected to wires (20), as in other cases, inserted in the central tube (22) which protects them until they are connected to the mains.

The ring nut (9) may be provided with hooking means or threads that allow the fastening of said ring nut to the fixed clutch elements (1). Said ring nut is the means that fastens to said fixed element the end elements (3, 3') when they are inserted in the cavity of the fixed element (1).

The hooking of the end movable element (3, 3') in the corresponding fixed element (1), obtained through ring nut (9), takes place when jackplugs (15) or springs (17) are put in touch with the related conductors (10, 11) and when also the blind fittings (3'), devoid of contacts, are inserted in the seats of the fixed elements (1) to be stopped as the bulb-carrying arms.

What has been described hereinabove is the system suitable, without exceptions, for all the embodiments of the lighting fixture of the present invention, wherein there are used:

- the end elements (3) of bulb-carrying arms provided with jackplugs (15) which inserts between the coils of the coiled conductors (10, 13) or springs (17) to be inserted on the cylindrical conductors (11) (or also on flat conductors for horizontal clutches, not shown), in order to obtain the necessary contacts;
- the two half-bodies (42, 44) which keep jackplugs (15) and spring (17) in the guide;
- and tube (21), possibly provided with more or less linear reference and sliding guides, necessary when said end fits in the seat of the fixed clutch element (1) (FIG. 6). Said tube (21) is the envelope wherein there is fixed with glues (39) the tubular arm (5) usually from crystal, in whose inside is located the double wire (41) which arrives at the attachment, either threaded or not, of bulb (6, 6'). The double wire (41) is fastened to each jackplug (15) or each spring (17) by clamps provided with screws (43).

Figure 2:
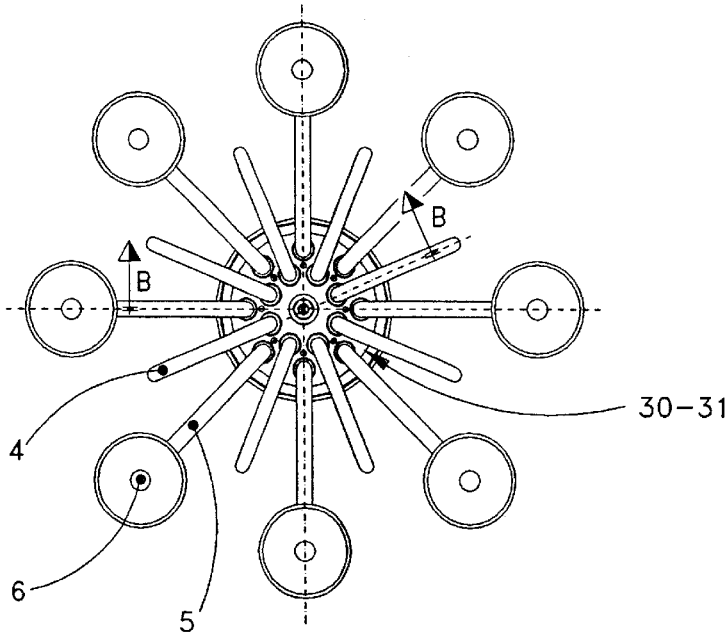
FIG. 2 is a top view of the lighting fixture of FIG. 1.

For the movable elements provided on the blind ends (3') of the arms carrying no bulbs, a blind tube (25) is used that, guided as tube (21), keeps in position in the right seats the ornamental arms, for instance the "pastorals" (4) (FIGS. 1 and 2). The blind tube end (3') is fixed to the tubular arm (4) by means of glues (39).

Concerning fixtures provided with vertical annular and cylindrical conductors (FIGS. 7 and 8), they include all the elements previously examined for coiled conductors (FIG. 8), with the use of shaped springs (17) instead of jackplugs (15). On inserting the clutch, said springs create each a stable contact with the provided conductors (11).

Figure 10:
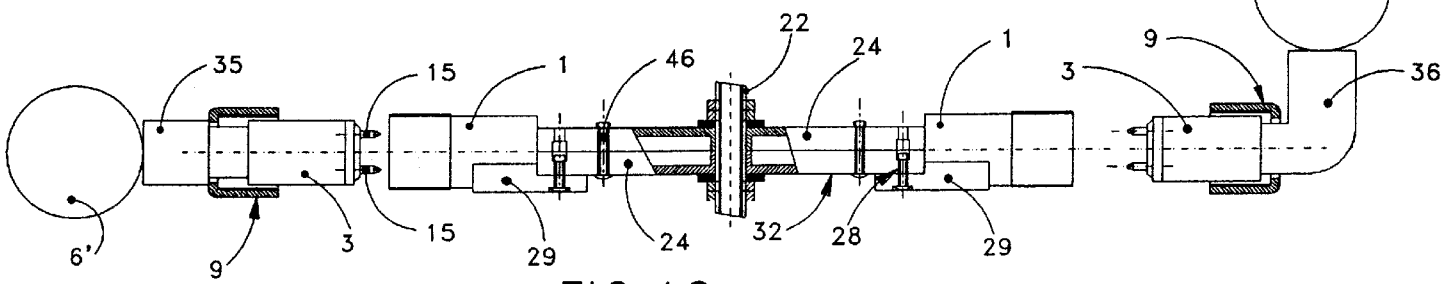
FIG. 10 is the same view as FIG. 9 and shows the assembly sequence of the various components that make up the fixture provided at the ends with two bulb-carrying arms, differently oriented with regard to one another.
Figure 11:
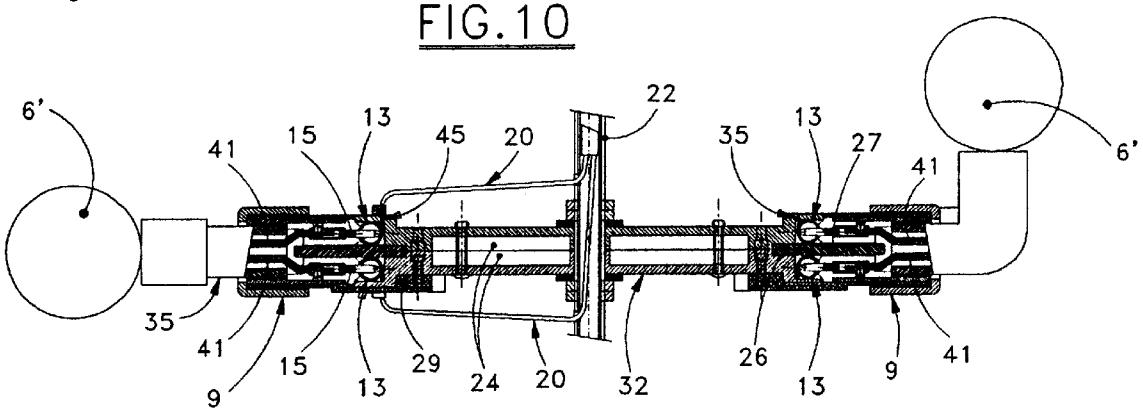
FIG. 11 is the side view of the central body of FIGS. 9 and 10, entirely assembled.

For the fixtures provided with horizontal coiled annular conductors (13) (FIGS. 10 and 11), clutch terminals are provided which are realised according to what has been previously said for vertical coiled annular conductors (10). For the movable clutches of blind elements (3') of the arms carrying no bulbs, necessary to support various elements such as rings (38) (FIGS. 3 and 12), a bracket (7,8) is provided without contacts and with a locking screw (48).

All the contrivances and improvements which have been introduced by the methods and means described and represented herein are necessary to define the lighting fixtures referred to hereinabove and which, to sum up, should be considered as having characteristics and properties which render them easily transportable in compact packages of a reduced size.

Besides, these fixtures can be assembled and mounted by those who purchase them, as they do no require technicians and experts for their final arrangement.

Although the invention has been described in conjunction with specific embodiments, alternatives and variations are possible within the scope of the appended claims.

What is claimed is:

1. A lighting fixture, comprising:

a central body including a circular insulating element;

a plurality of removable radial arms projecting from said central body wherein at least some of said removable radial arms are bulb carrying arms;

a pair of concentric peripheral circular seats formed in said insulating element separated by an insulating ring;

a plurality of protrusions extending from said insulating ring each being associated with a bulb carrying arm;

a pair of electrical conductors in the form of annular spiral springs disposed in said circular seats;

means for fastening said removable radial arms to said central body and electrically connecting said bulb carrying arms to a main; and said fastening means including a clutching means comprising:

a fixed element associated with each removable radial arm connected to said central body, each fixed element associated with a bulb carrying arm having said peripheral concentric seats and an extending protrusion serving as finger protection arranged at the base thereof;

a movable element disposed at an end portion of each removable radial arm;

each bulb carrying arm having electrical contact means in the form of jackplugs projecting from the movable element and said movable element also including a central hole therein;

the movable element being designed to be inserted into said fixed element whereby when so inserted said jackplugs are inserted between adjoining windings of said spiral springs disposed in said seats arranged at the base of said fixed element and said extending protrusion is received in said central hole.

2. The lighting fixture according to claim 1, wherein the jackplugs have a diameter greater than the space between two adjoining windings of the spiral springs.

3. The lighting fixture according to claim 1, wherein the movable element connected to the end portion of an arm carrying no bulb, comprises a blind tube, inserted and fixed to said end portion, and a ring nut surrounding and closing said blind tube at its open part opposite to the blind part.

4. The lighting fixture according to claim 1, wherein the movable element connected to the end portion of a bulb carrying arm comprises an open tube, inserted and fixed to said end portion, and two electric wires, each electric wire being connected, at one end, to a pole of a bulb-holder and, at the opposite end, to the jackplugs, the jackplugs being kept in position by two half-bodies inserted between the tube surface and each jackplug.

* * * * *